US010215105B1

(12) United States Patent
Nydam et al.

(10) Patent No.: US 10,215,105 B1
(45) Date of Patent: Feb. 26, 2019

(54) INTEGRATED VDA HOUSING WITH ANTI-ROTATION FEATURE

(71) Applicant: Continental Automotive Systems, Inc., Auburn Hills, MI (US)

(72) Inventors: Benjamin Nydam, Chatham (CA); Giri Thommandram, Chatham (CA); Donald Taylor, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 15/782,319

(22) Filed: Oct. 12, 2017

(51) Int. Cl.
*F02D 9/00* (2006.01)
*F02D 9/10* (2006.01)

(52) U.S. Cl.
CPC ..... *F02D 9/107* (2013.01); *F02D 9/1035* (2013.01)

(58) Field of Classification Search
CPC ..... F02D 9/107; F02D 9/1035
See application file for complete search history.

(56) References Cited

U.S. PATENT DOCUMENTS 5,341,773 A * 8/1994 Schulte ..... F02D 9/105 123/184.61
7,857,359 B2 * 12/2010 Zeitlinger ..... F28F 9/0246 285/182
9,657,878 B2 * 5/2017 Hartmann ..... F16L 37/088
2002/0185106 A1 * 12/2002 Storz ..... F02M 35/10144 123/337
2016/0377001 A1 * 12/2016 Taylor ..... F02D 9/1035 123/337
2018/0274402 A1 * 9/2018 Vericker ..... F01M 11/10

* cited by examiner

*Primary Examiner* — Hieu T Vo
*Assistant Examiner* — Sherman Manley

(57) ABSTRACT

A throttle control assembly which includes a throttle body housing, an adapter integrally formed with the throttle body housing, a housing portion being part of the adapter, and a central port which extends through the throttle body housing and the adapter. A first groove is integrally formed as part of the adapter, a second groove is integrally formed as part of the throttle body housing, and a rib portion disposed between the first groove and the second groove. The rib portion is formed as part of the adapter, and an anti-rotation feature is integrally formed with the throttle body housing. The anti-rotation feature is integrally formed with the throttle body housing during a molding process. The anti-rotation feature may be formed in different locations on the outer surface of the housing, allowing the throttle body assembly to be suitable for various applications having different design and packaging requirements.

18 Claims, 3 Drawing Sheets

INTEGRATED VDA HOUSING WITH ANTI-ROTATION FEATURE

FIELD OF THE INVENTION

The invention relates generally to an electronic throttle body having an integrally formed anti-rotation feature, where the anti-rotation feature is formed during a molding or casting process, and without the use of any additional machining processes.

BACKGROUND OF THE INVENTION

Electronic throttle bodies are generally known, and it is typical for a duct or conduit to be connected to and in fluid communication with the throttle body for directing air into the throttle body, where the throttle body controls the flow of the air into an engine. The conduit is commonly connected to the throttle body through the use of a connector, and the conduit is prevented from rotating relative to the throttle body by some type of anti-rotation feature, which is engaged with the conduit.

Typical throttle bodies have parts which are made as a single component, but certain parts that are formed as part of the throttle body are more complex, and expensive to manufacture. Some of the parts of the throttle body are formed using a casting process, and others are formed using various machining processes. Additional machining processes increase cost, and require additional steps during manufacturing. Some throttle bodies have an anti-rotation feature which is formed during subsequent manufacturing processes, such as machining, or the anti-rotation feature is formed as part of one of several separate components of the throttle assembly, which are assembled together. The use of the subsequent manufacturing processes, or manufacture of several components, increases costs, manufacturing time, and increases the overall complexity of manufacturing the throttle body assembly. Furthermore, throttle body assemblies made of several components assembled together are typically unable to meet stringent packaging requirements.

Accordingly, there exists a need for a throttle body which is simpler to manufacture, and includes an anti-rotation feature that is formed without the use of additional machining processes.

SUMMARY OF THE INVENTION

In one embodiment, the present invention is a throttle control assembly which includes a throttle body housing, an adapter integrally formed with the throttle body housing, a housing portion being part of the adapter, and a central port which extends through the throttle body housing and the adapter. A first groove is integrally formed as part of the adapter, a second groove is integrally formed as part of the throttle body housing, and a rib portion disposed between the first groove and the second groove. The rib portion is formed as part of the adapter, and an anti-rotation feature is integrally formed with the throttle body housing. The anti-rotation feature is integrally formed with the throttle body housing during a molding process.

A first relief notch and a second relief notch are formed as part of the throttle body housing. The first relief notch is located on one side of the anti-rotation feature, and the second notch is located on the opposite side of the anti-rotation feature.

In one embodiment, the first relief notch adjacent a first end of the first groove, and the first relief notch is adjacent a first end of the rib portion. The second relief notch is adjacent a second end of the first groove, and the second relief notch is adjacent a second end of the rib portion.

In one embodiment, the second groove includes a first portion and a second portion, where both the first portion terminates into the anti-rotation feature, and the second portion terminates into the anti-rotation feature.

One of the advantages of the throttle control assembly is that the anti-rotation feature may be formed in different locations on the outer surface of the housing. In one embodiment, an axis extends through the central port, and the anti-rotation feature may be located anywhere along an area of the outside surface of the housing which extends approximately 225° about the axis.

The anti-rotation feature may be formed using one of several processes. In one embedment, the anti-rotation feature is integrally formed with the housing during a casting process. In another embodiment, the anti-rotation feature is integrally formed with the housing during a metal injection molding process.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
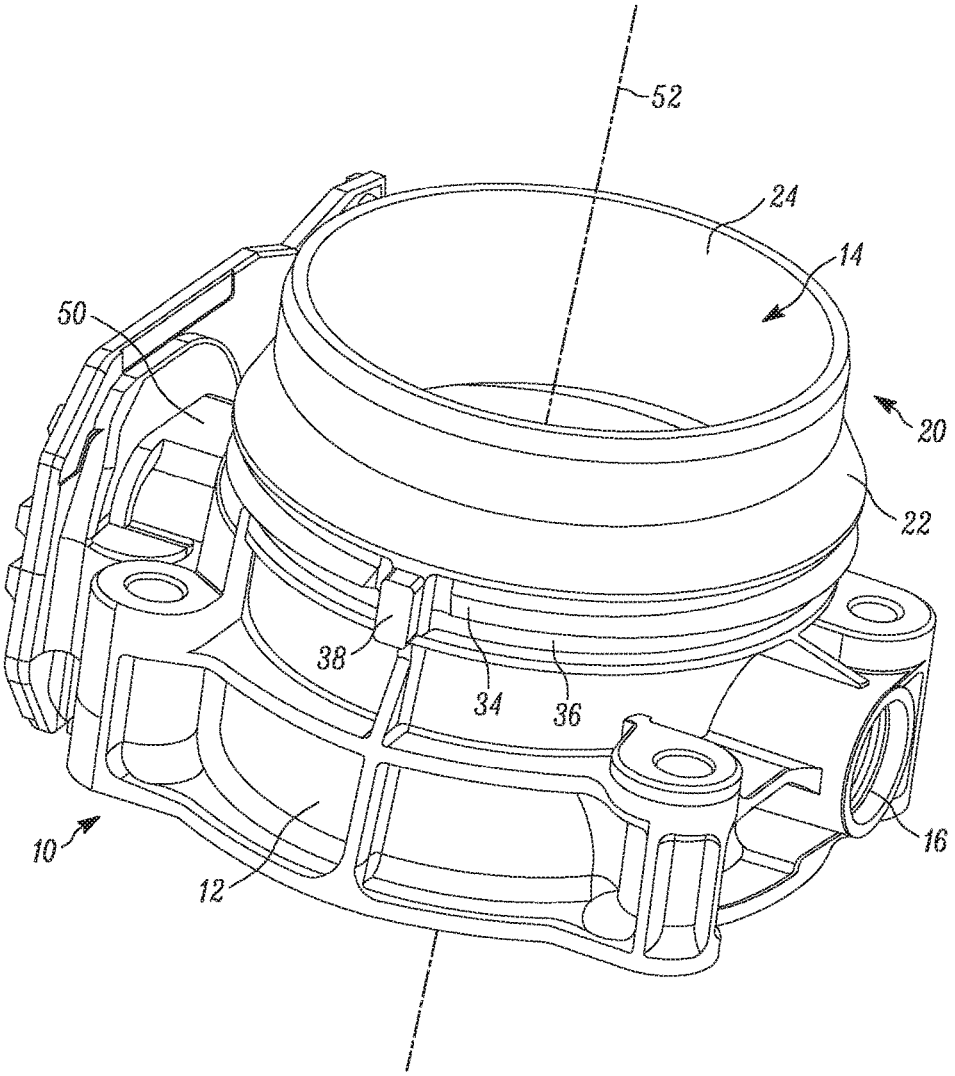
FIG. 1 is a perspective view of an electronic throttle body having an anti-rotation feature, according to embodiments of the present invention.
Figure 2:
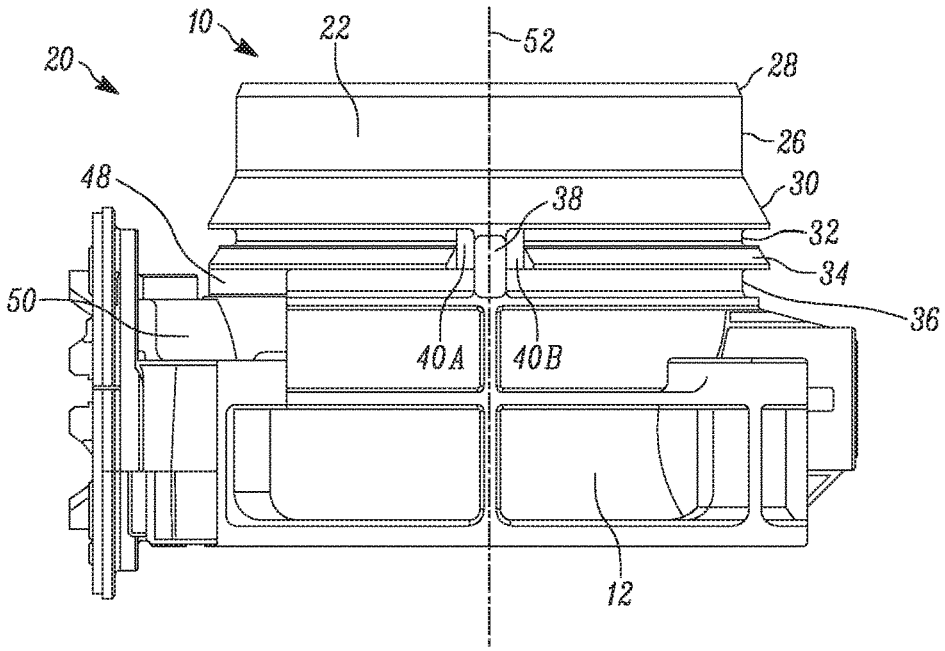
FIG. 2 is a front view of an electronic throttle body having an anti-rotation feature, according to embodiments of the present invention.
Figure 3:
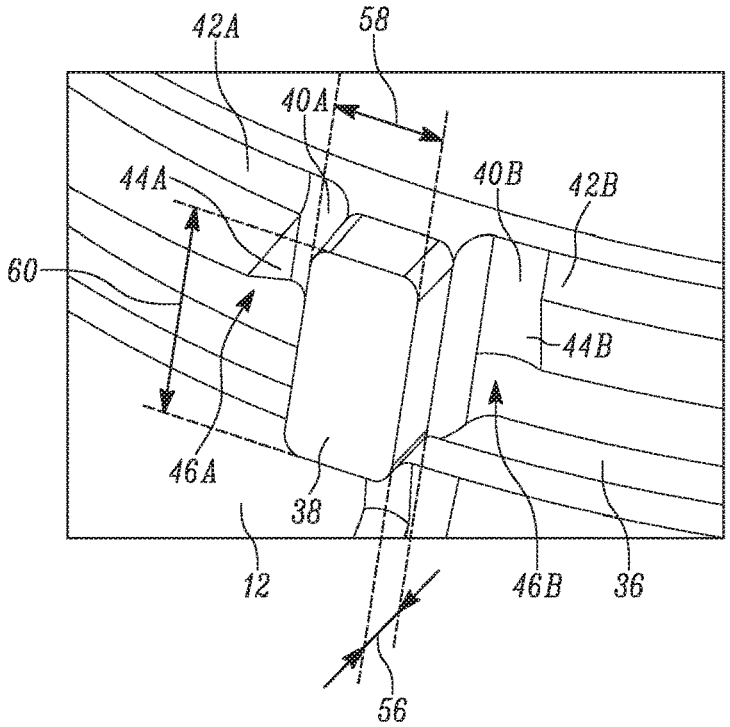
FIG. 3 is an enlarged perspective view of a portion of an electronic throttle body having an anti-rotation feature, according to embodiments of the present invention.
Figure 4:
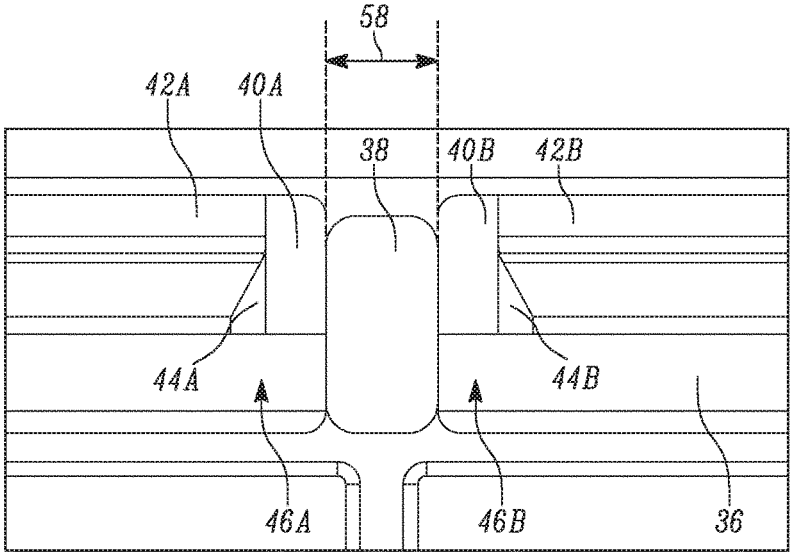
FIG. 4 is an enlarged front view of a portion of an electronic throttle body having an anti-rotation feature, according to embodiments of the present invention.

The following description of the preferred embodiment(s) is merely exemplary in nature and is in no way intended to limit the invention, its application, or uses.

An electronic throttle control assembly having an integrally formed anti-rotation feature according to the present invention in shown in the Figures generally at 10. The assembly 10 includes a throttle body housing 12, and formed as part of the housing 12 is a central port, shown generally at 14, through which air passes during operation of the assembly 10. There is a shaft (not shown) which extends through part of the central port 14, where the shaft is rotatable, and mounted to the shaft is a valve plate (also not shown).

The shaft is mounted in a bore 16 formed as part of the housing 12. The housing 12 also includes a portion 18 having a cavity, and disposed in the cavity 18 is an actuator (not shown). The actuator is used for controlling a gear assembly, which is then connected to the shaft, thereby controlling the position of the valve plate in the central port 14. Changing the position of the valve plate controls the flow of air through the central port 14.

The assembly 10 also includes an adapter, shown generally at 20, where the adapter 20 is suitable for connection with a conduit. The adapter 20 includes a housing portion 22, and formed as part of the housing portion 22 is an aperture 24, which forms part of the central port 14, and is of a substantially constant inner diameter. The remaining part of the central port 14 is formed as part of and extends through the housing 12. The housing portion 22 also includes a first diameter portion 26 which is adjacent a first tapered portion 28. The housing portion 22 also has a second tapered portion 30 which is adjacent the first diameter portion 26. Each of the tapered portions 28,30 facilitate the connection between a conduit and the throttle control assembly 10. During assembly, the housing portion 22 is inserted into an end portion of the conduit, and the tapered portions 28,30 and anti-rotation feature 38 provide proper alignment between the housing portion 22 and the conduit during the assembly process at the facility where the throttle control assembly 10 is manufactured.

Adjacent the second tapered portion 30 is a first groove 32, adjacent the first groove 32 is a rib portion 34, and adjacent the rib portion 34 is a second groove 36. Integrally formed with the housing 12 is an anti-rotation feature 38, which protrudes from the housing 12, and is adjacent the housing portion 22. Located on each side of the anti-rotation feature 38 is a relief notch 40A,40B. The first relief notch 40A is adjacent a first end 42A of the first groove 32, and a first end 44A of the rib portion 34. The second relief notch 40B is adjacent a second end 42B of the first groove 32, and a second end 44B of the rib portion 34. The second groove 36 has two portions, where the two portions of the second groove 36 are on opposite sides of the anti-rotation feature 38. A first portion, shown generally at 46A, of the second groove 36 terminates into the anti-rotation feature 38, and a second portion, shown generally at 46B, of the second groove 36 also terminates into the anti-rotation feature 38. The grooves 32,36 and rib portion 34 are also used for connecting the conduit to the assembly 10. The grooves 32,36 are able to receive a snap ring, clip, or some other type of connecting device for securing the conduit to the assembly 10.

The throttle control assembly 10 is formed using various manufacturing processes. The housing 12, second groove 36, anti-rotation feature 38, and relief notches 40A,40B are formed during a casting process.

Once the casting process is complete, various portions of the throttle control assembly 10 have yet to be formed. A machining process is then used to form the housing portion 22, the first groove 32, and the rib portion 34. The relief notches 40A,40B provide adequate space which allows for various tooling to be used as part of the machining process to form the housing portion 22, the first groove 32, and the rib portion 34. The second groove 36 partially circumscribes the housing 12. The first groove 32 and the rib portion 34 almost completely circumscribe the housing portion 22, with the exception of the areas occupied by the anti-rotation feature 38 and the relief notches 40A,40B.

The second groove 36 (formed during the casting process) does not entirely circumscribe the housing 12. An outer portion 48 partially circumscribes the housing 12 in an area along the outside of the housing 12 (where the second groove 36 was not formed during the casting process), such that the outer portion 48 is adjacent a part of the rib portion 34 in a similar manner to the second groove 36. The outer portion 48 is formed during the machining process along with the housing portion 22, the first groove 32, and the rib portion 34. Part of the outer portion 48 extends along the outside of the housing 12 in an area where the portion 18 having the cavity is integrally formed with the housing 12. Another part of the outer portion 48 also extends along the outside of the housing 12 along an area where a gear housing 50 is integrally formed with the housing 12.

Figure 5:
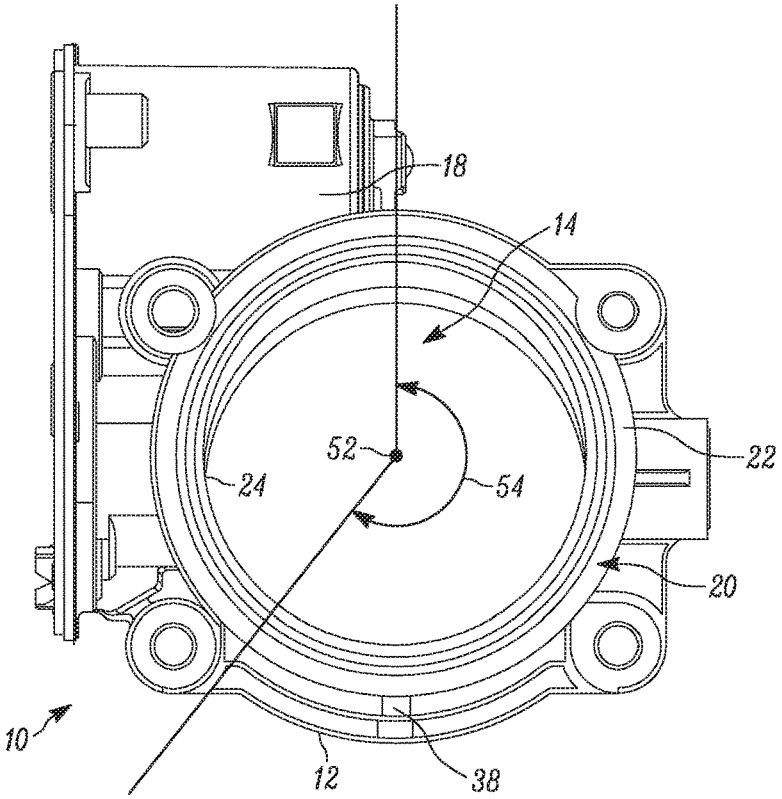
FIG. 5 is a top view of an electronic throttle body having an anti-rotation feature, according to embodiments of the present invention.

An axis 52 extends through the central port 14, and the anti-rotation feature 38 may be formed during the casting process at many possible locations along the outer surface of the housing 12. The anti-rotation feature 38 may be located on part of the outer surface of the housing 12 in an area on the outer surface of the housing 12 which extends at an angle 54 about the axis 52, shown in FIG. 5. The angle 54 in this embodiment is greater than one-hundred-eighty degrees (more specifically, in this embodiment, the angle 54 is approximately 225°), but it is within the scope of the invention that the angle 54 may be changed to suit a particular application. The angle 54 in this embodiment also corresponds to the degree of which the second groove 36 circumscribes the housing 12. Therefore, the location on the outer surface of the housing 12 where the anti-rotation feature 38 may be formed also corresponds to the degree of which the second groove 36 circumscribes the housing 12. Furthermore, the anti-rotation feature 38 may be located anywhere along the outer surface of the housing 12, with the exception of the area of the outer portion 48, to meet various packaging and design requirements.

The anti-rotation feature 38 being formed during the casting process, and the entire throttle control assembly 10 being formed as a single component, reduces the number of steps in the manufacturing process of the throttle control assembly 10, reducing manufacturing cost. Furthermore, during the casting process, the anti-rotation feature 38 may be formed along the line of draw within the die cast tool, such that the shape of the anti-rotation feature 38 does not have an effect on the removal of any tool inserts, tool sliders, or the separation of the mold components once the casting process is complete.

In this embodiment, the anti-rotation feature 38 extends away from the housing assembly 22 at a depth 56 of 3.875 millimeters. The anti-rotation feature 38 also has a width 58 of 5.0 millimeters, and a height 60 of 10.0 millimeters. However, the dimensions of the anti-rotation feature 38 may be varied to be suitable for various packaging and design requirements, as well as different types of conduits having different connecting devices.

While it has been described above that the housing 12, second groove 36, anti-rotation feature 38, and relief notches 40A,40B are formed during a casting process, it is within the scope of the invention that these components may be formed during other types of molding processes as well, such as, but not limited to, metal injection molding and 3D printing.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a throttle control assembly, including:

a housing;

an adapter integrally formed with the housing;

an anti-rotation feature integrally formed with the housing; and at least one relief notch formed as part of the housing, the at least one relief notch being located adjacent the anti-rotation feature;

wherein the anti-rotation feature is integrally formed with the housing during a molding process.

2. The apparatus of claim 1, further comprising:

a housing portion being part of the adapter; and a central port;

wherein part of the central port extends through the housing portion of the adapter, and part of the central port extends through the housing.

3. The apparatus of claim 1, further comprising:

a first groove integrally formed as part of the adapter;

a second groove integrally formed as part of the housing;

a rib portion disposed between the first groove and the second groove, the rib portion formed as part of the adapter; and wherein the first groove and the rib portion substantially circumscribe the adapter, and the second groove partially circumscribes the housing.

4. The apparatus of claim 3, the second groove further comprising:

a first portion; and a second portion;

wherein the first portion terminates into the anti-rotation feature, and the second portion terminates into the anti-rotation feature.

5. The apparatus of claim 3, the at least one relief notch further comprising:

a first relief notch formed as part of the housing; and a second relief notch formed as part of the housing;

wherein the first relief notch and the second relief notch are located on opposite sides of the anti-rotation feature.

6. The apparatus of claim 5, wherein the first relief notch adjacent a first end of the first groove, and the first relief notch is adjacent a first end of the rib portion.

7. The apparatus of claim 5, wherein the second relief notch is adjacent a second end of the first groove, and the second relief notch is adjacent a second end of the rib portion.

8. The apparatus of claim 1, wherein the anti-rotation feature is formed with the housing during a casting process.

9. The apparatus of claim 1, wherein the anti-rotation feature is formed with the housing during a metal injection molding process.

10. The apparatus of claim 1, further comprising an axis extending through the housing, wherein the anti-rotation feature is located on part of an area of the outside surface of the housing which extends approximately 225° about the axis.

11. An electronic throttle control assembly, comprising:

a throttle body housing;

an adapter integrally formed with the throttle body housing;

a housing portion being part of the adapter;

a central port extending through the throttle body housing and the adapter;

a first groove integrally formed as part of the adapter;

a second groove integrally formed as part of the throttle body housing;

a rib portion disposed between the first groove and the second groove, the rib portion formed as part of the adapter; and an anti-rotation feature integrally formed with the throttle body housing;

wherein the anti-rotation feature is integrally formed with the throttle body housing during a molding process.

12. The electronic throttle control assembly of claim 11, further comprising:

a first relief notch formed as part of the throttle body housing; and a second relief notch formed as part of the throttle body housing;

wherein the first relief notch is located on one side of the anti-rotation feature, and the second notch is located on the opposite side of the anti-rotation feature.

13. The electronic throttle control assembly of claim 12, wherein the first relief notch adjacent a first end of the first groove, and the first relief notch is adjacent a first end of the rib portion.

14. The electronic throttle control assembly of claim 12, wherein the second relief notch is adjacent a second end of the first groove, and the second relief notch is adjacent a second end of the rib portion.

15. The electronic throttle control assembly of claim 11, the second groove further comprising:

a first portion; and a second portion;

wherein the first portion terminates into the anti-rotation feature, and the second portion terminates into the anti-rotation feature.

16. The electronic throttle control assembly of claim 11, further comprising an axis extending through the central port, wherein the anti-rotation feature is integrally formed with part of an area of the outside surface of the housing which extends approximately 225° about the axis.

17. The electronic throttle control assembly of claim 11, wherein the anti-rotation feature is integrally formed with the housing during a casting process.

18. The electronic throttle control assembly of claim 11, wherein the anti-rotation feature is integrally formed with the housing during a metal injection molding process.

* * * * *